US006916201B1

(12) United States Patent
Chu

(10) Patent No.: US 6,916,201 B1
(45) Date of Patent: Jul. 12, 2005

(54) MICRO COAXIAL CABLE CONNECTING DEVICE

(75) Inventor: Chang-Hsing Chu, Taipei (TW)

(73) Assignee: Speed Tech Corp., Taoyuan Hsien (TW)

( * ) Notice: Subject to any disclaimer, the term of this patent is extended or adjusted under 35 U.S.C. 154(b) by 0 days.

(21) Appl. No.: 10/790,811

(22) Filed: Mar. 3, 2004

(51) Int. Cl.[7] ..... H01R 9/07
(52) U.S. Cl. ..... 439/582; 439/578
(58) Field of Search ..... 439/582, 578, 439/610, 607–609, 579–581, 585

(56) References Cited

U.S. PATENT DOCUMENTS 4,799,900 A * 1/1989 Capp et al. ..... 439/585
5,322,453 A * 6/1994 Resnick et al. ..... 439/581
5,569,049 A * 10/1996 Tatebe et al. ..... 439/394
5,879,190 A * 3/1999 Maruyama et al. ..... 439/582
6,305,980 B2 * 10/2001 Ko ..... 439/582
6,447,335 B1 * 9/2002 Ko ..... 439/585
6,508,668 B1 * 1/2003 Yamane ..... 439/582
6,554,644 B2 * 4/2003 Koide ..... 439/585
6,712,645 B1 * 3/2004 Chou ..... 439/582
6,739,907 B2 * 5/2004 Kuroda et al. ..... 439/582
6,790,082 B2 * 9/2004 Obayashi ..... 439/582
6,814,615 B2 * 11/2004 Laub et al. ..... 439/585
6,837,743 B2 * 1/2005 Ko ..... 439/582

* cited by examiner

*Primary Examiner*—Alexander Gilman
(74) *Attorney, Agent, or Firm*—Troxell Law Office, PLLC

(57) ABSTRACT

A micro coaxial cable connecting device, with application to cable to cable inter-connecting of micro coaxial cables, whereby the connecting device is separately configured as a female terminal connector and a male terminal connector, wherein the female terminal connector is assembled to include a signal terminal, an insulator, a conductor and a cover; and the male terminal connector is assembled to include a socket terminal, an insulator base and a casing. Structural design of the male terminal connector and the female terminal connector allows utilizing a lap joint method to connect said two connectors, and thereby enables reduction in production costs of connecting devices, provides enhancement in productivity, and answers to industrial utilization of such.

17 Claims, 6 Drawing Sheets

MICRO COAXIAL CABLE CONNECTING DEVICE

BACKGROUND OF THE INVENTION (a) Field of the Invention

The present invention relates to a micro coaxial cable connecting device, and more particularly to forsaking traditional butt joint method of connecting, and replacing such by utilizing a micro coaxial cable connecting device employing a lap joint method of connection, thereby enabling reduction in production costs of connecting devices, providing enhancement in productivity, and answering to industrial utilization of such.

(b) Description of the Prior Art

Referring to FIG. 1, which shows a conventional butt joint method of a micro coaxial cable, and with regard to cable-to-cable inter-connecting of micro coaxial cables, present industries accordingly employ a pair of multi media communication exchange (MMCX) but joint devices as a connecting medium for micro coaxial cables. This method of connecting is named a butt joint, however, present industries utilize a lathe processing method to produce the MMCX butt joint devices, making mass-production impossible, excluding productivity enhancement, and, moreover, resulting in overly high lathe processing production costs. In a competitive market environment of today, a need for advancement in design of such connecting devices is surely present.

In light of aforementioned shortcomings and inconvenience of the MMCX butt joint devices, inventor of the present invention, with a spirit of research for innovation and a striving for perfection, and employing professional insight and specialist know-how, originated a micro coaxial cable connecting device having practicability, offering a broader range of application, and answering to industrial utility value of such.

SUMMARY OF THE INVENTION

A micro coaxial cable connecting device of the present invention separately configured as a female terminal connector and a male terminal connector, wherein:

The female terminal connector is assembled to include a signal terminal, an insulator, a conductor and a cover. The signal terminal is designed as a long arm, whereby a narrow strip is formed in a middle thereof, having a pair of tongue-shaped contact arms extending downwards from one end of the narrow strip and formed thereof, and configured to contact with the male terminal connector. An inflected arm is separated to consist of a pair of tongue-shaped arms comprising a long arm and a short arm, which extend downwards from another end of the narrow strip on each side corresponding to the contact arms, and utilized to inflect round and clip-fasten a coaxial cable thereof. Moreover, the long arm and the short arm of the inflected arm form a clip orifice there between, allowing disposing a central conducting line of the coaxial cable therein. The insulator is utilized to function as a holder for the signal terminal and provide insulation between the signal terminal, the conductor and the cover. A frontal end of the insulator is configured to assume a cylindrical-shaped protrusion, and center of the protrusion is provided with a hollow defined to run through from top to bottom of the protrusion, thereby allowing disposing of the aforementioned contact arms of the signal terminal therein. Moreover, a hold-down strip is configured to upwardly protrude from the frontal end of the insulator, having dimensions appropriate to correspond with the rear end of the insulator when pressed down thereon. A load-bearing section is defined as an appropriately situated indentation section in the insulator, thereby allowing placing of the narrow strip of the signal terminal therein, and utilized to enable load bearing of the signal terminal thereof. A hold-bearing section is configured as an indentation defined in the rear end of the insulator, thereby allowing placing of the aforementioned inflexedarm of the coaxial cable therein. The conductor is utilized to function as a holder for load bearing and secure fastening of the insulator therein. A frontal end of the conductor downwardly extends to assume a cylindrical shaped indentation, thereby allowing placing of the protrusion of the insulator therein. At the same time, an annular spacing forms between the protrusion and the indentation. Two sides of the conductor form a pair of extended arms, which provide the coaxial cable with appropriate clasping force. The cover is made from metallic material and assumes a longitudinal shape, whereon a rectangular protrusion is appropriately positioned and defined, and utilized to increase strength of resistance to bending of the cover, as well as to ensure secure fastening of aforementioned components after assemblage. Three inflectable inflected arms are configured on a frontal end and two sides of the cover respectively, which provide effectiveness of guarding against electro magnetic interference (EMI), as well providing surfaces of application for applying a jig for pulling off the cover. A pair of injectable arms comprising a large inflected arm and a tail-inflected arm are separately configured on a rear end of the cover, and utilized to clip-fasten the conductor and the coaxial cable respectively.

The male terminal connector is assembled to include a socket terminal, an insulator base and a casing. The socket terminal is designed as a long arm, having one end formed to define a protruding post thereof, and utilized to contact with the signal terminal of the female connector. An inflected arm is separated to consist of a pair of tongue-shaped arms comprising a long arm and a short arm, which extend downwards from another end of the long arm of the socket terminal on a same side corresponding to the post, and utilized to inflect round and clip-fasten the coaxial cable thereof. The insulator base is utilized to function as a holder for load bearing the socket terminal and act as insulation between the socket terminal and the casing. A circular aperture is appropriately situated and defined in the insulator base, and utilized to receive and fasten the post of the socket terminal. A receive-bearing section is configured in an indentation defined at a rear end of the insulator base, and utilized to receive and fasten the socket terminal and squeezed portion of the coaxial cable therein. A side panel is configured so as to sidewardly extend and protrude upwards from the insulator base, and utilized when the socket terminal is placed into the insulator base, whereupon the inflected side panel is folded over and covers the socket terminal. Upon the socket terminal being clip-fastened into the insulator base, the side panel thereby ensures providing insulation between the socket terminal and the casing. The casing is made from metal material, and defined with a lengthwise frontal casing section, and a lengthwise rear casing section. Two fastening panels are extruded from two sides of the rear casing section, and utilized to fasten the aforementioned insulator base. The frontal casing section and the two fastening panels enclosedly define and there between form a receptacle spacing, which is thereby utilized to contain the insulator base therein. A cylindrical section is defined at and downwardly extends from an appropriate position in a frontal end of the frontal casing section. The cylindrical section is further defined with an annular groove, which is utilized to clip-fasten and contact with the female terminal connector. A pair of inflectable arms comprising a short inflected arm and a long inflected arm extend outwards from two sides of the rear casing section, and are utilized to hold down and fasten the coaxial cable. Moreover, a rectangular protrusion is defined on a connecting surface between the frontal casing section and the rear casing section, with which, after assemblage, is utilized to ensure secure fastening of aforesaid components.

A primary objective of the present invention is to provide a design for a lap joint method connecting device by means of the female terminal connector and the male terminal connector, thereby enabling reduction in production costs of connecting devices, enhancement in productivity, and answering to industrial utilization of such.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
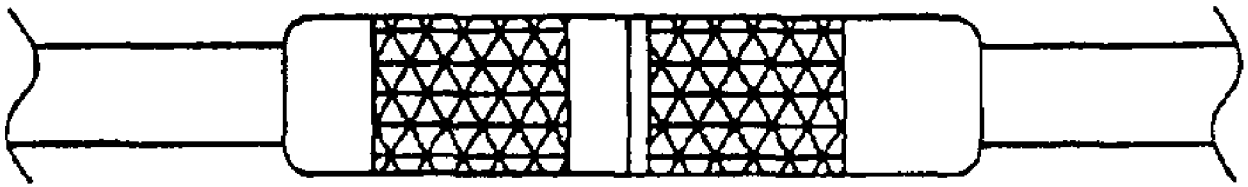
FIG. 1 Prior Art
FIG. 1 shows a schematic diagram of a conventional butt joint method of a micro coaxial cable.

Referring to FIGS. 2, 3, 4, and 5, which show a connecting device according to the present invention with application to cable inter-connecting of micro coaxial cables, whereby the connecting device is separately configured as a female terminal connector 1 and a male terminal connector 2, wherein:

The female terminal connector 1 is assembled to include a signal terminal 11, an insulator 12, a conductor 13 and a cover 14. The signal terminal 11 is designed as a long arm, whereby a narrow strip 113 is formed in a middle thereof, having a pair of tongue-shaped contact arms 112 extending downwards from one end of the narrow strip 113 formed thereof, and configured to contact with the male terminal connector 2. An inflected arm 111 is separated to consist of a pair of tongue-shaped arms comprising a long arm 1113 and a short arm 1112, which extend downwards from another end of the narrow strip 113 on each side corresponding to the contact arms 112, and utilized to inflect round and clip-fasten a coaxial cable A thereof. Moreover, the long arm 1113 and the short arm 1112 of the inflected arm 111 form a clip orifice 1111 there between, allowing disposing a central conducting line A1 of the coaxial cable A therein. The insulator 12 is utilized to function as a holder for the signal terminal 11 and provide insulation between the signal terminal 11, the conductor 13 and the cover 14. A frontal end of the insulator 12 is configured to assume a cylindrical-shaped protrusion 121, and center of the protrusion 121 is provided with a hollow 122 defined to run through from top to bottom of the protrusion 121, thereby allowing disposing of the aforementioned contact arms 112 of the signal terminal 11 therein. Moreover, a hold-down strip 123 is configured to upwardly protrude from the frontal end of the insulator 12, having dimensions appropriate to correspond with the rear end of the insulator 12 when pressed down thereon. A load-bearing section 124 is defined as an appropriately situated indentation section in the insulator 12, thereby allowing placing of the narrow strip 113 of the signal terminal 11 therein, and utilized to enable load bearing of the signal terminal 11 thereof. A hold-bearing section 125 is configured as an indentation defined in the rear end of the insulator 12, thereby allowing placing of the aforementioned inflexed arm 111 of the coaxial cable A therein. The conductor 13 is utilized to function as a holder for load bearing and secure fastening of the insulator 12 therein. A frontal end of the conductor 13 downwardly extends to assume a cylindrical shaped indentation 131, thereby allowing placing of the protrusion 121 of the insulator 12 therein. At the same time, an annular spacing 133 forms between the protrusion 121 and the indentation 131. Two sides of the conductor 13 form a pair of extended arms 132, which provide the coaxial cable A with appropriate clasping force. The cover 14 is made from metallic material and assumes a longitudinal shape, whereon a rectangular protrusion 141 is appropriately positioned and defined, and utilized to increase strength of resistance to bending of the cover 14, as well as to ensure secure fastening of aforementioned components after assemblage. Three injectable inflected arms 142 are configured on a frontal end and two sides of the cover 14 respectively, which provide effectiveness of guarding against electro magnetic interference (EMI), as well providing surfaces of application for applying a jig for pulling off the cover 14. A pair of injectable arms comprising a large inflected arm 143 and a tail inflected arm 144 are separately configured on a rear end of the cover 14, and utilized to clip-fasten the conductor 13 and the coaxial cable A respectively.

The male terminal connector 2 is assembled to include a socket terminal 21, an insulator base 22 and a casing 23. The socket terminal 21 is designed as a long arm, having one end formed to define a protruding post 211 thereof, and utilized to contact with the signal terminal 11 of the female connector 1. An inflected arm 212 is separated to consist of a pair of tongue-shaped arms comprising a long arm 2122 and a short arm 2121, which extend downwards from another end of the long arm of the socket terminal 21 on a same side corresponding to the post 211, and utilized to inflect round and clip-fasten a coaxial cable B thereof. The insulator base 22 is utilized to function as a holder for load bearing the socket terminal 21 and act as insulation between the socket terminal 21 and the casing 23. A circular aperture 221 is appropriately situated and defined in the insulator base 22, and utilized to receive and fasten the post 211 of the socket terminal 21. A receive-bearing section 222 is configured in an indentation defined at a rear end of the insulator base 22, and utilized to receive and fasten the socket terminal 21 and squeezed portion of the coaxial cable B therein. A side panel 223 is configured so as to sidewardly extend and protrude upwards from the insulator base 22, and utilized when the socket terminal 21 is placed into the insulator base 22, whereupon the inflected side panel 223 is folded over and covers the socket terminal 21. Upon the socket terminal 21 being clip-fastened into the insulator base 22, the side panel 223 thereby ensures providing insulation between the socket terminal 21 and the casing 23. The casing 23 is made from metal material, and defined with a lengthwise frontal casing section 231, and a lengthwise rear casing section 232. Two fastening panels 233 are extruded from two sides of the rear casing section 231, and utilized to fasten the aforementioned insulator base 22. The frontal casing section 231 and the two fastening panels 233 enclosedly define and there between form a receptacle spacing 234, which is thereby utilized to contain the insulator base 22 therein. A cylindrical section 235 is defined at and downwardly extends from an appropriate position in a frontal end of the frontal casing section 231. The cylindrical section 235 is further defined with an annular groove 236, which is utilized to clip-fasten and contact with the female terminal connector 1. A pair of injectable arms comprising a short inflected arm 237 and a long inflected arm 238 extend outwards from two sides of the rear casing section 232, and are utilized to hold down and fasten the coaxial cable B. Moreover, a rectangular protrusion 239 is defined on a connecting surface between the frontal casing section 231 and the rear casing section 232, with which, after assemblage, is utilized to ensure secure fastening of aforesaid components.

In accordance with aforementioned depiction of component parts and assemblage of such, the female terminal connector 1 and male terminal connector 2 are thereby connected employing a lap joint method, wherewith production costs of connecting devices are reduced, productivity is enhanced, and answers to industrial utilization of such.

Figure 2:
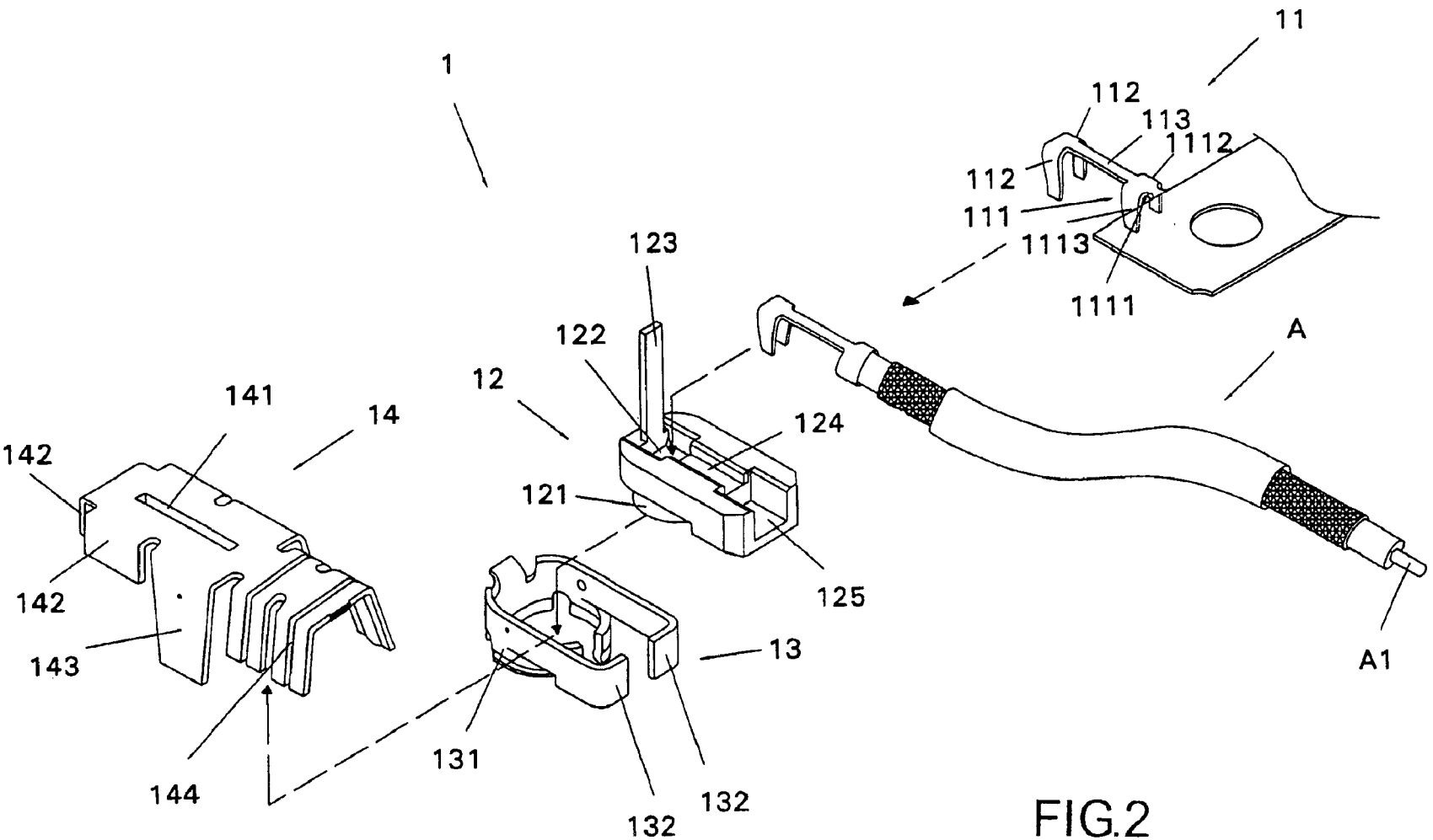
FIG. 2 shows an exploded elevational view of a female terminal connector according to the present invention.
Figure 4:
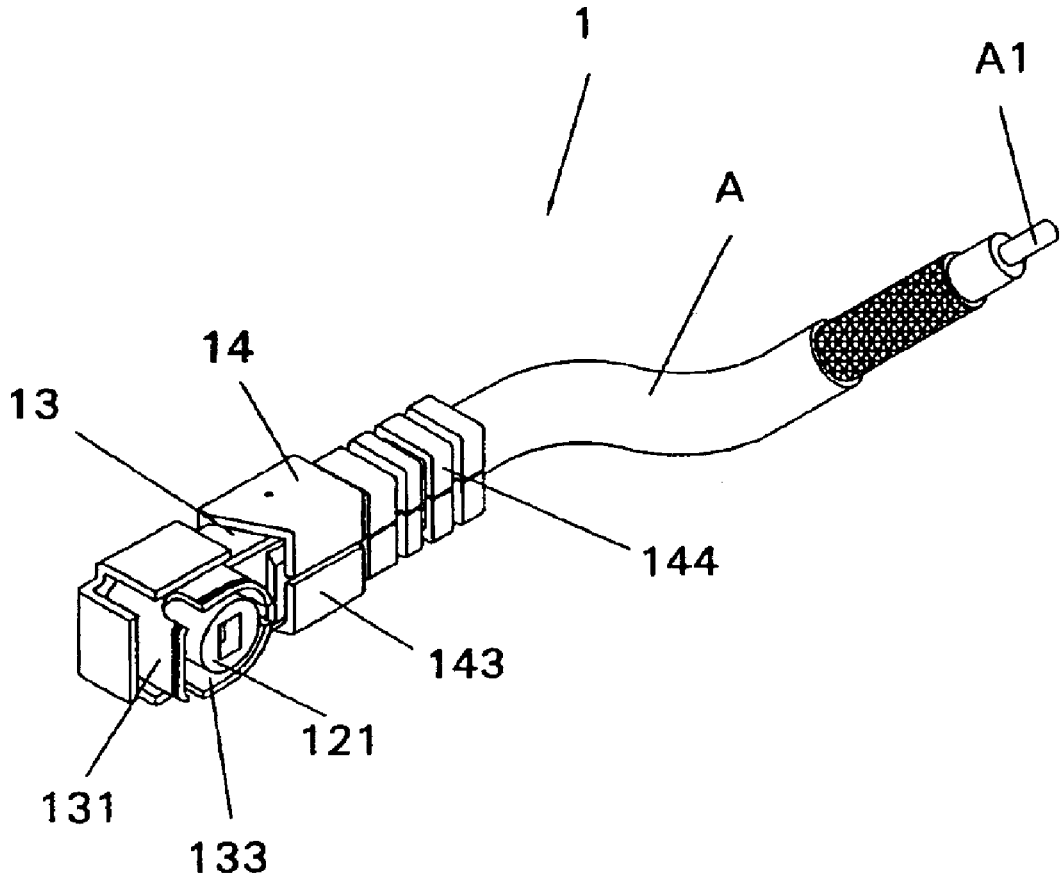
FIG. 4 shows an assembled elevational view of the female terminal connector according to the present invention.

Referring to FIGS. 2 and 4, and continuing on from aforementioned disclosures, essentials of assembling the female terminal connector 1 and the male terminal connector 2 according to the present invention are disclosed hereinafter.

When assembling the female terminal connector 1, firstly, place the central conducting line A1 of the coaxial cable A into the clip orifice 1111 formed between the inflected arm 111 of the signal terminal 11. At the same time, inwardly inflect the inflected arms 111 round the coaxial cable A and clip-fasten. Thereupon, dispose the aforementioned signal terminal 11 in the insulator 12, thereby allowing the contact arms 112 of the signal terminal 11 to be received within the hollow 122 defined within the insulator 12. Dispose the narrow strip 113 of the signal terminal 11 in the load-bearing section 124 of the insulator 12, thereby supporting the load-bearing section 124. Clip-fasten the inflected arm 111 round the coaxial cable A, thereby appropriately disposing the signal terminal 11 within the hold-bearing section 125 defined as an indentation in the rear end of the insulator 12. Thereafter, bend over the hold-down strip 123 protruding from the frontal end of the insulator 12 to squeeze down and cover the load-bearing section 124. Thereat, dispose the aforementioned insulator 12 within the conductor 13, thereby allowing the protrusion 121 of the insulator 12 to be received within the indentation 131 of the conductor 13, and providing the two extended arms 132 extending from two sides of the conductor 13 an appropriate clasping force to clasp the coaxial cable A there between, as well as preclude slackening of the insulator 12, the signal terminal 11 and the coaxial cable A after placement in the conductor 1. Lastly, place the cover 14 securely onto the conductor 13, and apply a common jig to clasp-fasten the three inflected arms 142 configured on left, right and front sides of the frontal end of the cover 14 and the large inflected arms 143 defined on the rear end of the cover 14 onto the conductor 13 thereof. The tail-inflected arm 144 thereon clasps the coaxial cable A, and thus completes assemblage of the female terminal connector 1.

Figure 3:
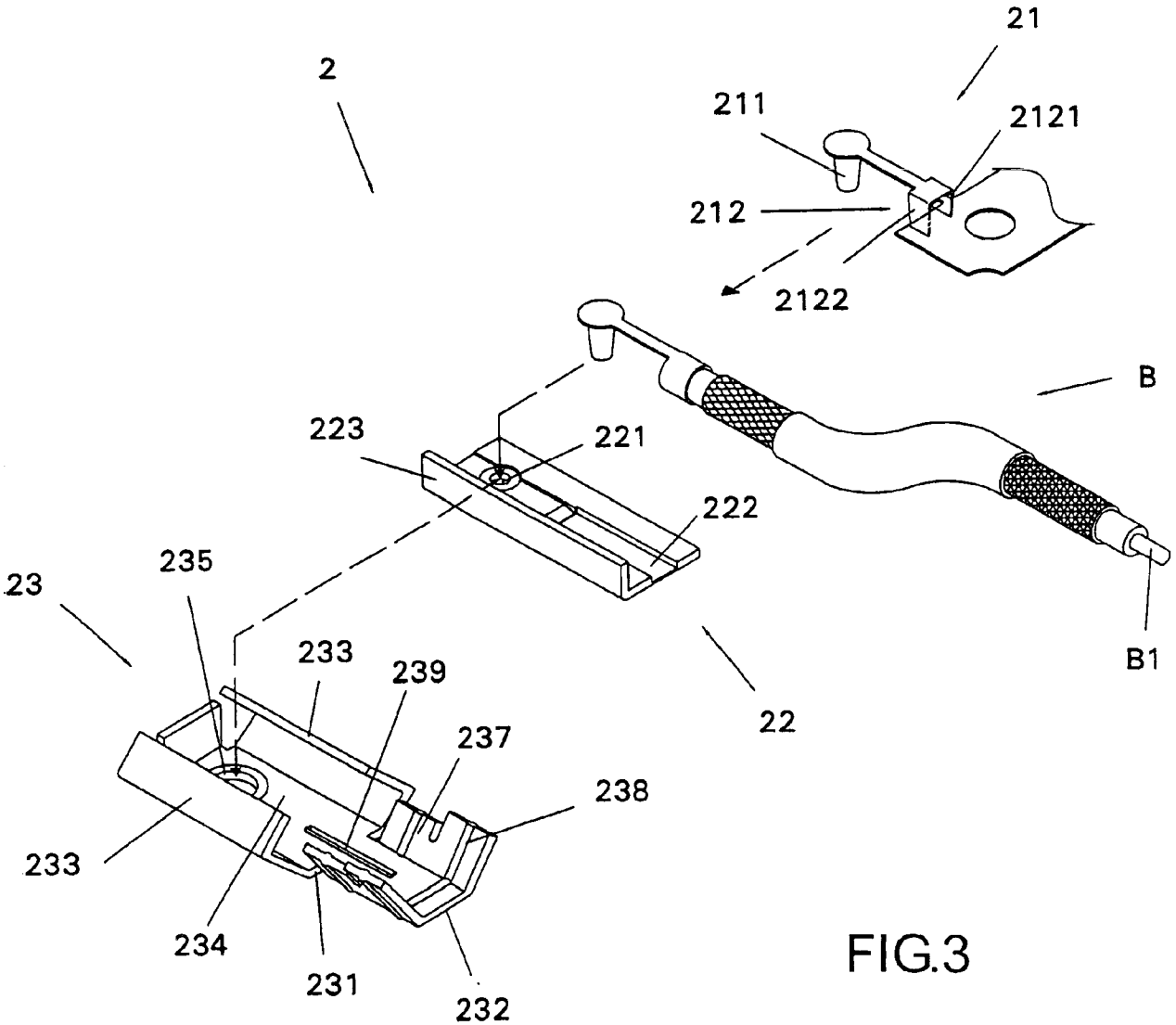
FIG. 3 shows an exploded elevational view of a male terminal connector according to the present invention.
Figure 5:
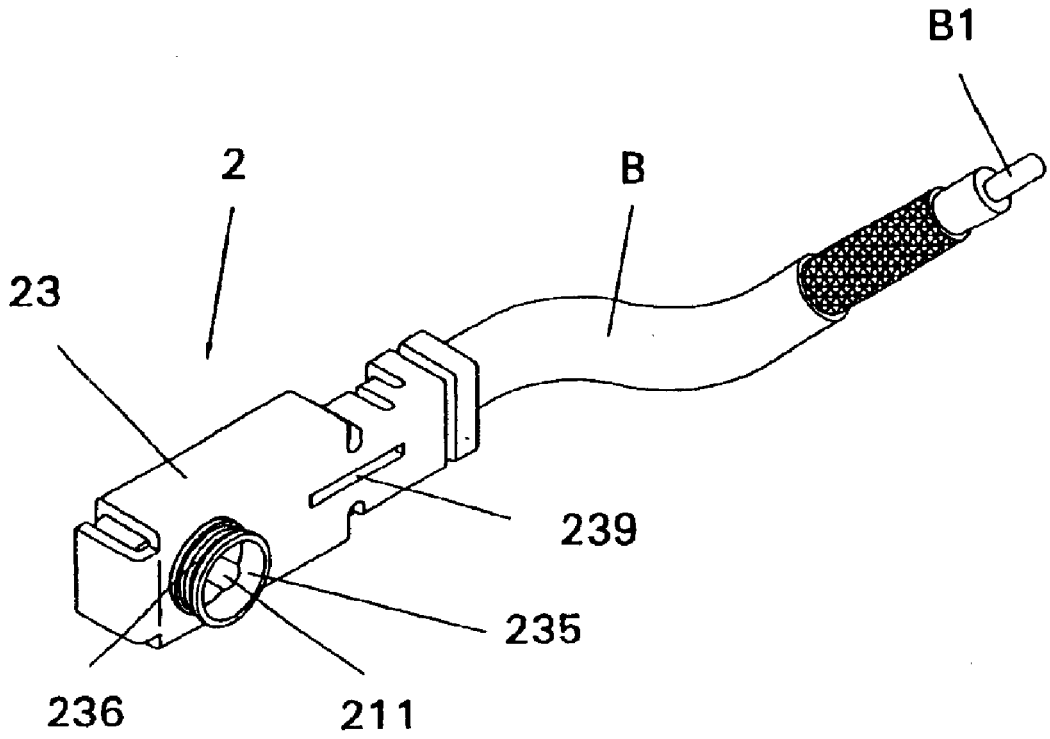
FIG. 5 shows an assembled elevational view of a male terminal connector according to the present invention.

Referring to FIGS. 3 and 5, when assembling the male terminal connector 2, firstly place the central conducting line B1 of the coaxial cable B between the long arm 2122 and short arm 2121 of the socket terminal 21. At the same time, inwardly inflect the long arm 2122 and the short arm 2121 round the coaxial cable B and clip-fasten such. Thereupon, dispose the aforementioned socket terminal 21 in the insulator base 22, thereby allowing the post 211 of the socket terminal 21 to be received within the circular aperture 221 of the insulator base 22. Thereupon, dispose the socket terminal 21 and squeezed portion of the coaxial cable B within the receive-bearing section 222 defined in the rear end of the insulator base 22. Afterward, fold over the sidewardly extruded side panel 223 of the insulator base 22 so as to cover the socket terminal 21. Thereat, dispose the aforementioned insulator base 22 within the receptacle spacing 234 of the casing 23, thereby allowing the post 211 of the socket terminal 21 to be received within the cylindrical section 235 of the casing 23. Lastly, apply a common jig to cover and fasten the fastening panels 233 of the casing 23 over the insulator base 22. Thereupon, clip-fasten the pair of short inflected arms 237 and the pair of long inflected arms 238 round the coaxial cable B thereof, and thus complete assemblage of the male terminal connector 2.

Figure 6:
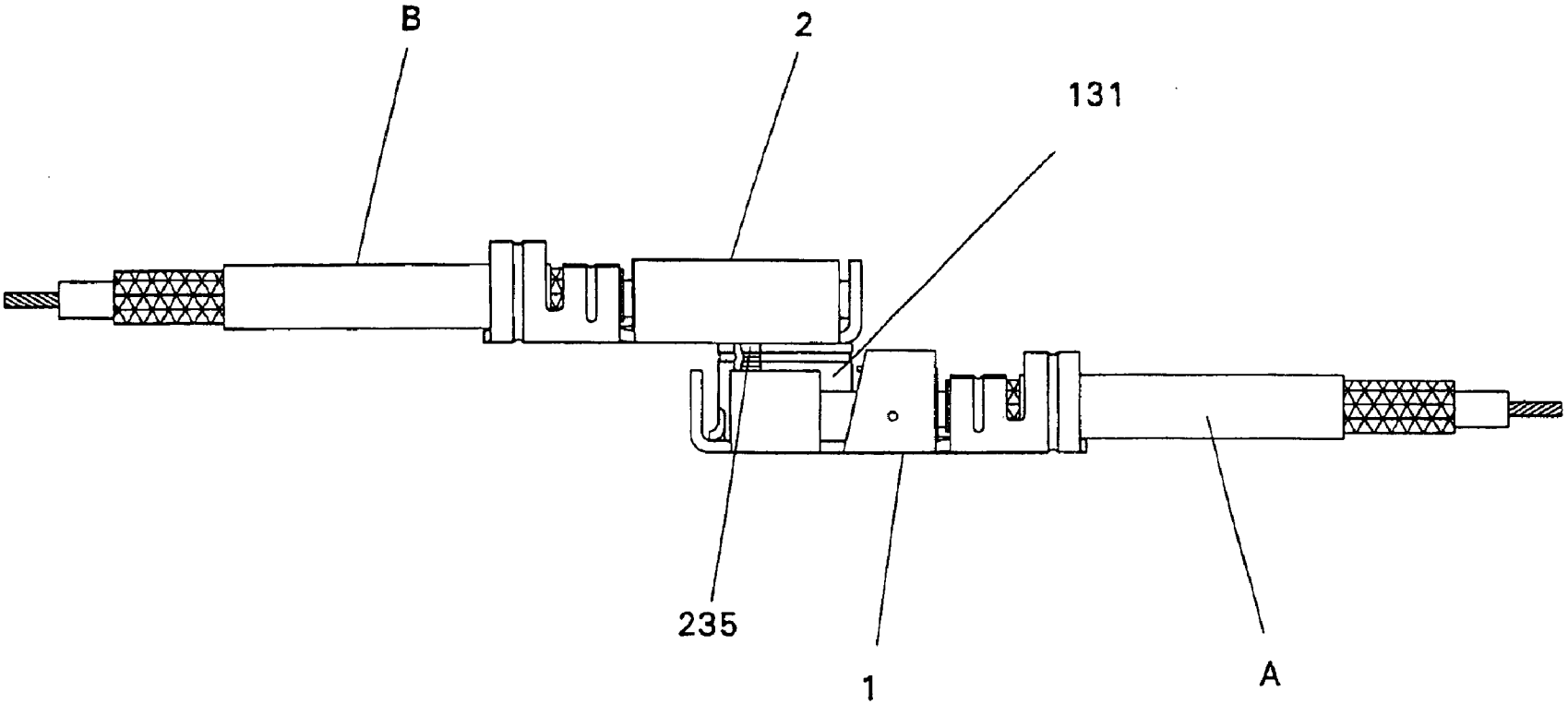
FIG. 6 shows a schematic view of the male-female terminal connectors lap jointed together according to the present invention.

Referring to FIG. 6, which shows the female terminal connector 1 and the male terminal connector 2 joined together. The cylindrical section 235 of the assembled male terminal connector 2 is oriented towards the indentation 131 of the female terminal connector and conjoined therein, thereby allowing the cylindrical section 235 of the male terminal connector 2 to be received within the annular spacing 133 (see FIG. 4). At the same time, allowing the signal terminal 11 and the socket terminal 21 to be mutually embedded, and thus completes joining together of the female terminal connector 1 and the male terminal connector 2.

In conclusion, structural design of the micro coaxial cable connecting device according to the present invention can benefit present industries employed in pressing techniques production, allowing lower production costs compared to production costs required of traditional MMCX connecting devices. Moreover, the present invention facilitates mass-production of connecting devices, thus significantly increasing productivity, and providing utility value to industries. Furthermore, the micro coaxial cable connecting device according to the present invention offers innovation and advancement, and thus assuredly complies with essential elements for a patent application, accordingly such is proposed herewith.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A micro coaxial connecting device comprising a female terminal connector and a male terminal connector, wherein:

the female terminal connector comprises a signal terminal, an insulator, a conductor and a cover, wherein the signal terminal is designed as a long arm, two ends of whom are formed to define a pair of contact arms and a pair of inflected arms respectively; a hold-down strip and a protrusion are configured in a frontal end of the insulator, and a load-bearing section is defined as an appropriately situated indentation section in the insulator; a hold-bearing section is configured as an indentation defined in a rear end of the insulator, and center of the protrusion is configured with a hollow defined to run through from top to bottom of the protrusion, thereby allowing disposing of the contact arms of the signal terminal therein; a frontal end of the conductor downwardly extends to assume an indentation, thereby allowing placing of the protrusion of the insulator therein; a pair of injectable arms comprising a large inflected arm and a tail inflected arm are separately configured on a rear end of the cover, and utilized to clip-fasten the conductor and a coaxial cable respectively;

the male terminal connector comprises a socket terminal, an insulator base and a casing, wherein the socket terminal is designed as a long arm, having one end formed to define a protruding post thereof, and on another end of the socket terminal a pair of inflected arms extend downwards on same side corresponding to the post; a circular aperture is appropriately situated and defined in the insulator base, a receive-bearing section utilized to receive and fasten the socket terminal and squeezed portion of the coaxial cable therein is configured in an indentation defined at a rear end of the insulator base, a frontal casing section of the casing utilized to contain the insulator base therein forms a receptacle spacing, a cylindrical section is defined at and downwardly extends from an appropriate position in a frontal end of the receptacle spacing, inflectable arms utilized to hold down and fasten the coaxial cable extend outwards from two sides of a rear casing section, and the contact arms of the signal terminal and the post of the socket terminal mutually embed, thereby allowing joining together of the female terminal connector and the male terminal connector thereof.

2. The micro coaxial connecting device as claimed in claim 1, wherein a clip orifice is formed between the inflected arms of the signal terminal.

3. The micro coaxial connecting device as claimed in claim 1, wherein the inflected arms of the signal terminal comprise a long arm and a short arm.

4. The micro coaxial connecting device as claimed in claim 1, wherein the protrusion of the insulator is cylindrical shaped.

5. The micro coaxial connecting device as claimed in claim 1, wherein the indentation of the conductor is cylindrical shaped.

6. The micro coaxial connecting device as claimed in claim 1, wherein after disposing the protrusion of the insulator of the female terminal connector into the indentation of the conductor, an annular spacing is formed there between.

7. The micro coaxial connecting device as claimed in claim 1, wherein two sides of the conductor form a pair of extended arms.

8. The micro coaxial connecting device as claimed in claim 1, wherein a frontal end and two sides of the cover are configured as inflected arms.

9. The micro coaxial connecting device as claimed in claim 1, wherein a rectangular protrusion is configured on the cover of the female terminal connector.

10. The micro coaxial connecting device as claimed in claim 1, wherein the pair of inflected arms of the socket terminal comprises a long arm and a short arm.

11. The micro coaxial connecting device as claimed in claim 1, wherein a side panel is configured so as to extend and protrude from one side of the insulator base.

12. The micro coaxial connecting device as claimed in claim 1, wherein the pair of inflected arms of the rear casing section of the casing comprises a long inflected arm and a short inflected arm.

13. The micro coaxial connecting device as claimed in claim 1, wherein the frontal casing section and two fastening panels of such form a receptacle spacing there between.

14. The micro coaxial connecting device as claimed in claim 1, wherein an annular groove is configured on the cylindrical section of the frontal casing section of the male terminal connector, and utilized to clip-fasten and contact with the female terminal connector.

15. The micro coaxial connecting device as claimed in claim 1, wherein a rectangular protrusion is configured on the casing of the male terminal connector.

16. The micro coaxial connecting device as claimed in claim 1, wherein the casing of the male terminal connector is made from metal material.

17. The micro coaxial connecting device as claimed in claim 1, wherein the cover of the female terminal connector is made from metal material.

* * * * *